United States Patent [19]

Naoumidis et al.

[11] Patent Number: 4,702,784

[45] Date of Patent: Oct. 27, 1987

[54] PROCESS FOR PRODUCTION OF A TUNGSTEN CARBIDE-ACTIVATED ELECTRODE

[75] Inventors: Aristides Naoumidis; Herbert Neumeister, both of Julich; Arno Schirbach, Eschweiler; Bernd D. Struck, Langerwehe; Dieter Triefenbach, Julich, all of Fed. Rep. of Germany

[73] Assignee: Kernforschungsanlage Julich Gesellschaft mit beschrnakter Haftung, Julich, Fed. Rep. of Germany

[21] Appl. No.: 741,637

[22] Filed: Jun. 5, 1985

Related U.S. Application Data

[63] Continuation-in-part of Ser. No. 502,478, Jun. 9, 1983, abandoned.

[30] Foreign Application Priority Data

Jun. 15, 1982 [DE] Fed. Rep. of Germany ..... 3222436

[51] Int. Cl.[4] ..... C25B 1/22; C25B 11/12

[52] U.S. Cl. ..... 156/89; 156/335; 204/104; 204/290 R; 204/294; 427/399

[58] Field of Search ..... 156/89, 335, DIG. 69; 204/290 F, 290 R, 294, 104; 427/58, 69, 113, 126.3, 226, 228, 249, 399, 301, 333, 380; 428/408; 445/35, 46; 313/346 R, 345

[56] References Cited

U.S. PATENT DOCUMENTS

| | | | |
|---|---|---|---|
| 1,077,920 | 11/1913 | Stevens | 204/290 F |
| 3,055,789 | 9/1962 | Gemmi | 156/327 |
| 3,432,336 | 3/1969 | Langrod et al. | 427/399 |
| 3,619,286 | 11/1971 | Gutnajer | 204/290 R X |
| 3,778,300 | 12/1973 | Wohlberg | 427/399 |
| 4,126,489 | 11/1978 | Williams | 427/399 X |
| 4,203,821 | 5/1980 | Cramer et al. | 204/294 X |
| 4,308,114 | 12/1981 | Das et al. | 204/294 X |
| 4,426,269 | 1/1984 | Brown et al. | 204/290 R |
| 4,473,454 | 9/1984 | Asano et al. | 204/290 R |

FOREIGN PATENT DOCUMENTS

| | | | |
|---|---|---|---|
| 0062308 | 4/1968 | German Democratic Rep. . | |
| 0116653 | 1/1959 | U.S.S.R. | 156/89 |

OTHER PUBLICATIONS

Li, K. C. et al., Tungsten, pp. 155–157, 182, Reinhold Publ. Corp., N.Y., 1943.

Ivory, R. A., "Tungsten Carbide Research in Germany", BIOS Final Report No. 925, Item Nos. 21 and 22, PB79296, 1947, pp. 27–33.

*Primary Examiner*—Donald E. Czaja
*Assistant Examiner*—Ramon R. Hoch
*Attorney, Agent, or Firm*—Scully, Scott, Murphy & Presser

[57] ABSTRACT

A process is disclosed for the production of a tungsten carbide-activated electrode, particularly an electrode which is utilizable as a cathode, and which consists of an electrically-conductive substrate with an active surface layer of tungsten carbide. The tungsten carbide is adhesively bonded through chemical reaction to the surface of a substrate which is constituted of graphite or a graphite-like material. The graphite-like material is a graphite binder mixture, whose binder material components, other than the graphitic filler granules, are only carbonized, and may not be completely graphited.

16 Claims, No Drawings

PROCESS FOR PRODUCTION OF A TUNGSTEN CARBIDE-ACTIVATED ELECTRODE

This application is a continuation-in-part application of U.S. patent application Ser. No. 502,478, filed Jun. 9, 1983, now abandoned.

BACKGROUND OF THE INVENTION

1. Field of the Invention

The present invention relates to a process for production of a tungsten carbide-activated electrode, particularly an electrode which is utilizable as a cathode, and which consists of an electrically-conductive substrate with an active surface layer of tungsten carbide.

Electrodes of the above-mentioned type are, in general, required as cathodes during electrolysis for hydrogen generation in an acidic environment, and in particular, during electrolysis in a sulfuric acid solution, or in the cathodic formation of hydrogen or during the cathodic formation of hydrogen and the concurrent anodic oxidation of sulfur dioxide in sulfuric acid electrolytes. Particular examples are related to the electrochemical oxidation of $SO_2$ from waste gases during $H_2$ production, as well as the analogous electrolysis in the sulfuric acid-hybrid continuous cycle process.

2. Discussion of the Prior Art

A known process for the production of tungsten carbide-activated electrodes consists of the initial preparation of tungsten carbide and applying the latter in the form of a powder by means of a binding agent (polyimide or polysulfone) onto the substrate. However, the electrodes which are produced in this manner fail to exhibit a sufficiently high electrochemical activity.

Furthermore, another process is known according to which there can be produced cathodes imparted with a sufficiently high electrochemical activity (P. Cavallotti in Hydrogen as an Energy Vector, edited by A.A. Strub and G. Imarisio, D. Reidel Publishing Company, Dordrecht/Boston/London, 1980, p. 408, EUR 6783). Pursuant to this known process, a tungsten carbide-teflon binder layer is applied onto a gold-coated substrate. Nevertheless, this type of process is extremely expensive due to the utilization of the noble metal.

Another known process for the production of a tungsten carbide-activated electrode consists in the cold-pressing of active tungsten carbide together with graphite powder into the electrode (H. Bohm, Chem.-Ing.-Techn. 49 (1977, 328). The thusly produced cathodes provide only relatively low cathodic current densities, which leads to the conclusion that the electrodes possess an unsatisfactory grain structure.

SUMMARY OF THE INVENTION

Accordingly, it is an object of the invention to provide a novel process for the production of a tungsten carbide-activated electrode, in which there is avoided the utilization of expensive noble metals but which, nevertheless, leads to electrodes which are stable over lengthy periods and which possess a high electric chemical activity.

The foregoing object is achieved, in conformance with the present invention, by adhesively bonding the tungsten carbide through chemical reaction to the surface of the substrate which comprises graphite or a graphite-like material. With respect to a graphite-like material it is understood that this relates to a graphite binder mixture wherein binder material components other than the graphitic filler granules are only carbonized, but not completely graphited.

The process pursuant to the invention can be effected in different modes. Thus, an adhesive bond is achieved between the substrate and the tungsten carbide layer through the vapor deposition of tungsten metal to produce a bond between the solids through chemical reaction and subsequent carburizing into tungsten carbide which is bonded as such to the substrate.

An advantageous mode in carrying out the process pursuant to the invention further consists in applying tungsten oxide, or a compound which is thermally decomposable into tungsten oxide, onto the substrate. The tungsten oxide, or the tungsten compound possibly through thermal decomposition to tungsten oxide, is converted through reducing and carburizing on the substrate into tungsten carbide, and thereby is bonded as such to the substrate. The quantity of the tungsten oxide which is applied onto the substrate consists of 50 to 350 mg per $cm^2$.

In accordance with the process pursuant to the invention, the tungsten compound (Tungsten oxide or the tungsten compound which is decomposable into tungsten oxide), can be directly applied onto the substrate without the utilization of any binder material. The process is carried out advantageously by initially applying a thin binder material layer on the substrate and the tungsten compound onto the binder material. The thickness of the layer is dimensioned so that it will be just sufficient for adherence of the tungsten compound which is to be applied and for the formation of the adhesive bond, but insufficient to cover a portion of the tungsten oxide or the tungsten compound with binder material. A particularly high electrochemical activity of the electrode is obtained through the present process.

The binder material is either completely used up during the carburizing phase, or if not completely used up, it is carbonized and forms a layer between the formed tungsten carbide and the substrate. Since, as has been indicated, the carbonized binder material is conductive, the formation of a layer consisting of carbonized binder material between the tungsten carbide and the substrate will not substantially alter the electrochemical activity. However, it can be advantageous to employ a binder material to which graphite powder is admixed in order to increase the conductivity of the binder material which has been so carbonized. The binder material may also comprise a phenolic resin.

A particularly advantageous modification of the process pursuant to the invention consists in the substrate being a so-called green body or base material formed using a binding agent-containing graphite powder, wherein the weight of binding agent is from about 10 to 40% by weight of the substrate. Consequently, the resulting substrate includes binding agent on the surface thereof and obviates the need for the further application of a binder medium layer.

For applications in which a porous electrode is required, it is suitable for the substrate to comprise a porous diaphragm comprised of graphite. In such a case, the tungsten compound is applied onto the substrate with a binder.

Advantageously, a tungsten oxide powder is employed for application onto the substrate, the powder being produced from para-ammonium tungstate through precipitation to tungstic acid and subsequent decomposition in air at about 550° C., or direct thermal decomposition of para-ammonium tungstate, and having a specific surface layer than 10 $m^2/g$. A further embodiment of the invention consists in applying tungstic acid or para-ammonium tungstate on the substrate, and then thermally decomposing on the substrate prior to the reduction and carburizing.

The reduction of the tungsten oxide is suitably carried out by bringing the substrate with the tungsten oxide thereon under a hydrogen atmosphere or a hydrogen-inert gas atmosphere, and heating to a temperature of from about 350° C. to about 600° C. and especially about 370° to 580° C. Usually, the flowing gas consists of 1 to 3 liters of hydrogen/hour/$cm^2$ of the cross-sectional surface of the vessel in which the substrate is contained. The heating is continuously carried out for a period of from about 1 to about 5 hours and especially from about 1 to about 3 hours commencing from 20° C. The tungsten oxide ($WO_3$) is reduced to a mixture of different oxide phases having the composition $WO_x(0.33 \leqq x \leqq 3)$.

After the reduction of the tungsten oxide, and prior to the carburizing, the sample is heated in an inert gas atmosphere (for example, about 2 liters/hour of flowing argon per $cm^2$ cross-sectional surface of the vessel) within about 0.7 to 2 hours at a rise of 1 to 2° K./min. to 620° C. For the carburizing, the substrate with the tungsten oxide located thereon is then heated within a temperature range of 620° to 950° C. at a temperature rise of about 1° K./min. under a flowing $CO/CO_2$ atmosphere wherein the volumetric ratio of CO: $CO_2$ is from about 2:1 to about 30:1. The volumetric ratio of the CO to $CO_2$ usually is about 10:1 and the volumetric flow about 1.5 liters/hour per $cm^2$ cross-sectional surface of the vessel. Subsequent to reaching the final temperature, in accordance with the type of the proceeding process steps, for instance, whether the tungsten compound is applied with or without binder, heating is maintained for up to 4 hours in conformance with the thickness of the binding medium layer. If possible, the carburizing period should be extended until all of the tungsten oxide is converted into tungsten carbide. In order to obtain the highest possible electrochemical activity of the electrode not all of the applied tungsten oxide need be fully converted into tungsten carbide, but there preferably should remain only an extremely small amount of tungsten oxide, if any.

In the foregoing steps of (1) reduction under a hydrogen atmosphere or hydrogen-inert gas atmosphere,(2) heating in an inert gas atmosphere (e.g.—argon) and (3) carburizing under a flowing $CO/CO_2$ atmosphere, tungsten metal is also present as well as tungsten oxide. Accordingly, the foregoing three process steps also apply to the substrate that has tungsten metal applied to it especially tungsten metal without tungsten oxide also being present as well as tungsten metal substantially free of tungsten oxide.

In a preferred embodiment of the invention tungsten, in the form of tungsten metal, tungsten oxide or a compound that is thermally decomposable into tungsten oxide is applied to the surface of a substrate comprising graphite or a graphite-like material. The tungsten is converted into tungsten carbide through thermal treatment at temperatures of up to 950° C. in a $CO/CO_2$ environment, thereby adhesively bonding the tungsten to the surface of the substrate through a chemical reaction.

After the carburizing phase, the substrate with the formed tungsten carbide layer, is maintained under a flowing hydrogen gas at 750° C. for the reduction of carbon when present on the substrate surface.

The electrodes produced in accordance with the process of the invention are advantageously employed as a cathode in an electrolytic cell for the implementation of the sulfuric acid-hybrid continuous cycle process, or as the cathode in an electrolytic cell for the anodic oxidation of $SO_2$ waste gases at concurrent cathodic $H_2$ formation.

EXAMPLE 1

A substrate was prepressed from a mixture of electro- and natural graphite powder with a binder component of 20% by weight (phenolic resin). Onto this substrate there was applied in a uniformly distributed manner about 170 mg/$cm^2$ of tungsten oxide. The prepressed substrate with the thereon applied tungsten oxide was thereafter pressed at room temperature under a pressure of 200 MPA for 15 seconds. The pressed members had a diameter of 16 mm ($F=2$ $cm^2$) and a thickness of about 2.5 mm.

The pressed members were then continually heated in a quartz tube (internal diameter=35 mm, $F=10$ $cm^2$) under flowing hydrogen (20 liters $H_2$/hour) for about 2 hours from 20° C., to 370° C., whereby the $WO_3$ was reduced to $WO_x$ $(0.33 \leqq x \leqq 3)$.

Subsequently, argon (20 liters/hour) was passed through the quartz tube and the pressed forms further heated up to 500° C. For carburizing, the pressed members were heated from a temperature of 580° C. at a temperature rise of 1.4° K./min. up to 760° C., whereby a gas mixture consisting of CO and $CO_2$ ($CO/CO_2$ volumetric ratio of 9:1; volumetric flow up to 15 liters/hour) was conducted through the tube.

The finished electrodes with the tungsten carbide-activated surface were electrochemically examined at 80° C. in 50% by weight of $H_2SO_4$. At −100 mV, in comparison with the reversible hydrogen electrode (RHE) in the same solution, there was recorded the cathodic current density of the hydrogen development as a measure for the activity of the electrode. Under the mentioned investigating conditions there was achieved a current density of 210 mA/$cm^2$. The electrode was operated under the previously mentioned conditions for 1000 hours and remained without practically any weight loss.

EXAMPLE 2

A substrate of electrographite was coated with a 20% (by weight) solution of a phenolic resin binder in methanol. The thereby produced, extremely thin binder coating was thereafter uniformly coated with tungsten oxide powder (170 mg/$cm^2$).

The reduction and carburizing of the tungsten oxide layer was carried out as described in Example 1.

The subsequent cathodic measurement of the electrode under the investigation condition described in Example 1 provided a current density of 150 mA/$cm^2$ at −100 mV in comparison with RHE.

EXAMPLE 3

Serving as a device for the implementation of the process was a vertically standing quartz tube with an internal diameter of 30 mm and a length of 900 mm, which was heatable in its lower portion by means of a resistance oven and in its upper portion by means of an induction coil. In the middle of the resistance-heated region there was located a crucible with tungsten hexachloride ($WCl_6$), and in the region of the induction coil, a graphite disc with a diameter of 16 mm and a thickness of 2 mm was suspended from a tungsten wire.

In order to avoid annealing and cooling effects, the $WCl_6$ was initially heated to about 240° C. in a stationary argon/hydrogen atmosphere, and thereafter the graphite disc was rapidly heated inductively to about 650° C. Thereafter, the gas flow was set into motion upwardly from below, and the quartz tube passed through with an argon/hydrogen gas mixture (hydrogen component 4%) with a flow of 10 l/min was passed through the quartz tube. The waste gases were neutralized with NaOH in a wash flask connected to the outlet of the quartz tube.

In this manner, the $WCl_6$ vapor, together with the $H_2$ of the carrier gas, was reduced on the surface of the graphite disc to tungsten metal, and the surface was coated. At the preset conditions, there was presently produced within two minutes a coating thickness of about 10 μm independently of the roughness of the surface of the graphite disc. At a coating period of about 3 minutes there was obtained a coating thickness of 15 μm.

The thus coated graphite disc was thereafter maintained in the same quartz tube in a $H_2$/HCl gas mixture (mixture ratio of 8:2) with a component of about 1% propane at a temperature of 750° C. for 30 minutes, whereby the metallic tungsten reacted to form tungsten carbide and was thereby adhesively bonded with the graphitic substrate.

The graphite disc which was coated with tungsten carbide was examined with respect to its suitability as a cathode. At 80° C. in 50% by weight of $H_2SO_4$, and at −100 mv voltage in comparison with the reversible hydrogen electrode (RHE) there was measured a cathodic current density of the hydrogen development of 180 mA/cm$^2$.

What is claimed is:

1. In a process for production of a tungsten carbide-activated electrode used for acid electrolysis, which consists essentially of an electrically-conductive substrate comprising graphite or a graphite-like material, said substrate having a surface active layer of tungsten carbide; the improvement comprising applying tungsten oxide or a compound which is thermally decomposable into tungsten oxide onto the surface of said substrate, converting said tungsten compound through thermal decomposition into tungsten oxide followed by reduction on said substrate to form tungsten carbide, including thermal treatment at temperatures of up to 950° C. in a $CO/CO_2$ environment, and as such bonding said tungsten carbide with said substrate.

2. Process as claimed in claim 1, comprising applying tungsten oxide powder on said substrate by means of a carbonizable binder.

3. Process as claimed in claim 2, comprising a binder medium having graphite powder admixed therewith for increasing the conductivity of said binder is been carbonized after carburizing.

4. Process as claimed in claim 3, wherein said binder medium comprises a phenolic resin.

5. Process as claimed in claim 3, wherein said substrate comprises a base material formed of a binder material containing a graphite powder.

6. Process as claimed in claim 5, wherein said substrate includes 10 to 40% by weight of a binder material.

7. Process as claimed in claim 1, wherein said substrate comprises a porous diaphragm of graphite.

8. Process as claimed in claim 1, comprising forming tungsten oxide powder from a para-ammonium tungstate through a precipitation reaction into tungstic acid, and subsequent decomposition in air at about 550° C. to tungsten oxide or direct thermal decomposition of para-ammonium tungstate to tungsten oxide.

9. Process as claimed in claim 8, wherein the specific surface of the tungsten oxide powder is greater than 10m$^2$/g.

10. Process as claimed in claim 1, comprising applying tungstic acid or para-ammonium tungstate on said substrate, and thermally decomposing said tungstic acid or ammonium tungstate into tungsten oxide, prior to said reduction and carburization on said substrate.

11. Process as claimed in claim 1, wherein said substrate with the tungsten oxide applied thereon is reduced by heating in a hydrogen atmosphere or hydrogen-inert gas atmosphere to a temperature of from about 350° C. to about 600° C.

12. Process as claimed in claim 1, where the volumetric ratio of $CO/CO_2$ is from about 2:1 to about 30:1.

13. Process as claimed in claim 1, wherein said substrate with said tungsten oxide applied thereon is heated for the carburization thereof to within a temperature range of 620° to 950° C. at a temperature rise of about 1°K./min. in a flowing $CO/CO_2$ atmosphere.

14. Process as claimed in claim 13, wherein subsequent to said carburization, said substrate with said formed tungsten carbide layer is maintained at 750° C. under a flowing hydrogen gas for reduction of any carbon on said substrate surface.

15. A process comprising a sulfuric acid-hybrid continuous cycle using, as a cathode in an electrolytic cell, a tungsten carbide-activated electrode made according to the process of claim 1.

16. A process comprising anodic oxidation of $SO_2$ waste gases in an electrolytic cell at a concurrent cathodic hydrogen formation using a tungsten carbide-activated electrode made according to the process of claim 1.

* * * * *